US007408759B2

(12) United States Patent
Gefter et al.

(10) Patent No.: US 7,408,759 B2
(45) Date of Patent: Aug. 5, 2008

(54) SELF-CLEANING IONIZATION SYSTEM

(75) Inventors: Peter Gefter, South San Francisco, CA (US); Gregory Vernitsky, San Francisco, CA (US); Scott Gehlke, Berkeley, CA (US)

(73) Assignee: MKS Ion Systems, Inc., Alameda, CA (US)

( * ) Notice: Subject to any disclaimer, the term of this patent is extended or adjusted under 35 U.S.C. 154(b) by 0 days.

(21) Appl. No.: 11/739,173

(22) Filed: Apr. 24, 2007

(65) Prior Publication Data

US 2007/0235661 A1 Oct. 11, 2007

Related U.S. Application Data

(63) Continuation-in-part of application No. 10/956,189, filed on Sep. 30, 2004, now Pat. No. 7,212,393.

(51) Int. Cl.
*H01T 23/00* (2006.01)
*B03C 3/155* (2006.01)

(52) U.S. Cl. ..... 361/230; 96/58; 96/69; 96/70; 96/78

(58) Field of Classification Search ..... 250/427, 250/423 R, 324; 361/230; 315/111.81
See application file for complete search history.

(56) References Cited

U.S. PATENT DOCUMENTS

| | | | | | |
|---|---|---|---|---|---|
| 3,856,674 | A * | 12/1974 | Kalman | ..... | 210/774 |
| 5,641,340 | A * | 6/1997 | Kagan | ..... | 95/273 |
| 5,647,890 | A * | 7/1997 | Yamamoto | ..... | 95/69 |
| 5,855,653 | A * | 1/1999 | Yamamoto | ..... | 96/58 |
| 6,709,495 | B1 * | 3/2004 | Storer | ..... | 96/58 |
| 7,212,393 | B2 * | 5/2007 | Gefter et al. | ..... | 361/230 |

* cited by examiner

*Primary Examiner*—David A. Vanore
*Assistant Examiner*—Johnnie L Smith, II
(74) *Attorney, Agent, or Firm*—Fenwick & West LLP

(57) ABSTRACT

A module for generating ions in a flowing air stream includes a support structure having a central region adapted to pass a flowing air stream therethrough, and including a plurality of supports for positioning a filamentary ion-generating electrode in a polygonal configuration within the central region. The supports and filament are relatively moveable to wipe the surface of the filament at each support for removing accumulated contaminants on the filament.

17 Claims, 6 Drawing Sheets

SELF-CLEANING IONIZATION SYSTEM

RELATED APPLICATION

This application is a continuation-in-part of application Ser. No. 10/956,189, entitled "Air Ionization Module and Method," filed on Sep. 30, 2004, which application is incorporated herein in the entirety by this reference thereto.

FIELD OF THE INVENTION

This invention relates to an ionizing system and more particularly to a self cleaning electrode system that includes a filamentary ion emitting electrode.

BACKGROUND OF THE INVENTION

Air ionizers that use gas, such an air, to disperse ions typically operate by moving the gas past ionizing electrodes that produce ions due to corona discharge in response to high ionizing voltage applied to the electrodes.

The moving gas disperses ions in a flowing stream toward objects to be charged or discharged. Particles, usually present in air, accumulate on a highly-charged surface of ionizing electrodes, thus reducing ion output and changing a balance between generated positive and negative ions produced by the ionizing electrodes.

Conventional methods and apparatuses for cleaning pointed or needle-like ionizing electrodes commonly include manually operated brushes that sweep tips of ionizing electrodes and dislodge accumulated particles. Alternatively, brushes installed on a rotating hub of a fan that produces the flow of gas relies upon centrifugal force to move the brushes in and out of contact with ionizing electrodes to dislodge accumulated particles.

In ionizers having an ionizing electrode formed as a thin wire (filament), the ionizing electrode also attracts particles and requires periodic cleaning. Such filament can also be cleaned manually as by brushing but over a substantially larger area than for ionizers with emitter points. And, areas next to supports for a filament cannot be sufficiently cleaned by a rotating brush.

SUMMARY OF THE INVENTION

In accordance with one embodiment of this invention, a filament stretched to a polygonal shape is cleaned by sliding the filament against supports that support the flexible filament in the polygonal shape.

An air ionizer includes an ionizing filament stretched between supports into a polygonal shape that is disposed within a flowing air stream. The filament slides against the supports to dislodge accumulated particles. In accordance to one embodiment of the present invention both ends of the filament electrode are attached to a lever that provides connection between the filament and a high voltage power supply. Sliding movement of the filament is produced by moving the lever or by moving the filament supports, or both. In another embodiment of the present invention high ionizing voltage can be supplied through at least one filament support and the lever can be fully situated within an area of a flowing air stream.

DETAILED DESCRIPTION OF THE INVENTION

Figure 1:
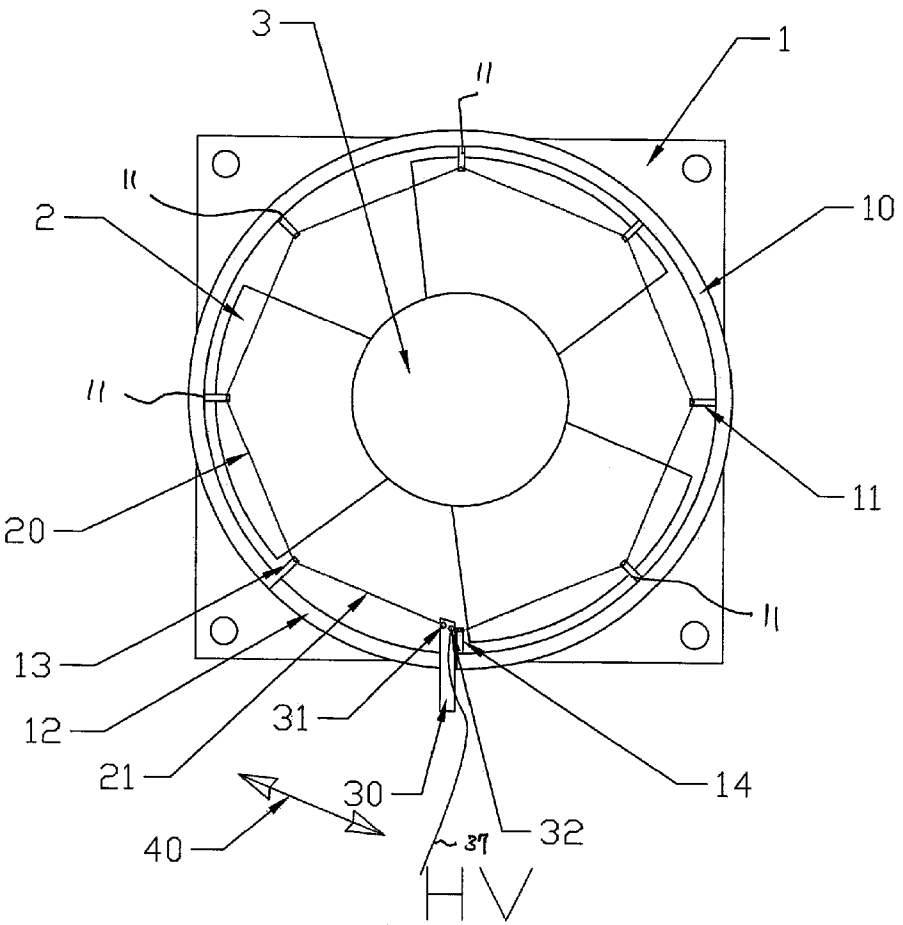
FIG. 1 is a frontal view of an ionizing blower from the impeller side of the fan module in accordance with one embodiment of the present invention.

In one embodiment of the present invention, as illustrated in FIG. 1, rotary fan module 1 operates to move the air in an airflow direction. An ionizing electrode in a form of a filament (corona wire) 20 is stretched in a polygonal shape between wire supports 11 that are attached to cylindrical support structure 10 to position the filament in an area of maximum airflow and close to the outer edges of fan blades 2.

Of course, the filament 20 can be situated on the inlet side of the fan module 1 where hub 3 is situated, for example, on the opposite or output side of the fan. Wire supports 11 may be shaped as hooks, eyelets, cylinders, or other suitable shape for supporting the filament 20 in stretched configuration, as shown, and facilitating the sliding of the filament 20 through the supports 11.

Both ends of the filament 20 are attached to lever 30 at separate attachment points 31 and 32, or optionally at the same point. Lever 30 extends outside of the support structure 10 and is situated between adjacent wire supports 13 and 14 within a cut-out area 12 of the support structure 10.

High ionizing voltage is connected to corona wire 20 via a conductor 37 along lever 30, as shown. Alternatively, high ionizing voltage may be supplied to the filament 20 through a wire support 11, or via other convenient connection.

Lever 30 is mounted for movement along a cleaning path 40 that is substantially parallel to segment 21 of the polygon shape of filament 20, with the attachment points 31 and 32 remaining located along segment 21. The filament 20 thus slides along or through supports 11 to dislodge accumulated particles. Segment 21 may be longer than other segments of polygonal shape of filament 20 to facilitate cleaning of a full length of the filament 20, including areas adjacent to the supports 11, in response to movement of the lever 30 along the cleaning path 40.

Lever 30 can be moved along the cleaning path manually, or by solenoid, pneumatic cylinder, or other suitable known device and the lever 30 can occupy any position within area 12 of the support structure 10 after a cleaning procedure, or can be moved back to an original position.

Figure 2A:
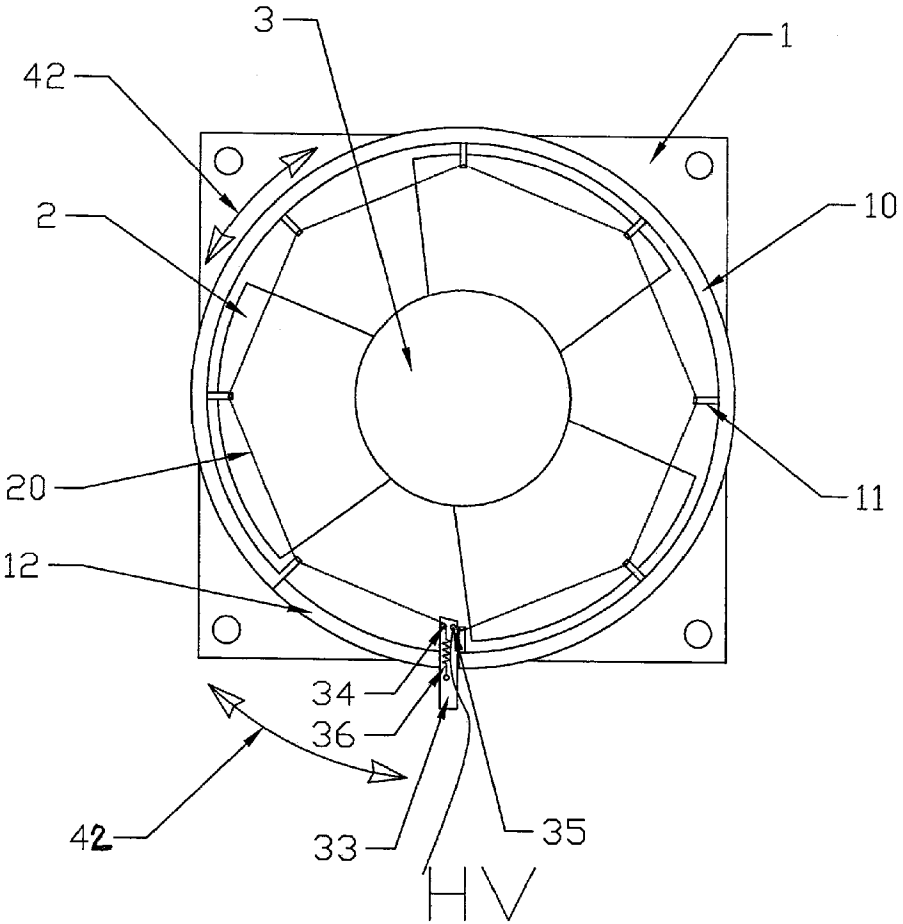
FIG. 2A and FIG. 2B are frontal views of an ionizing blower from the impeller side of the fan module showing a lever mechanism in accordance with another embodiment of the present invention.

In another embodiment of present invention, as shown on FIG. 2A, the support structure 10 of the fan module 1 is rotatable substantially coaxially with the rotary fan and hub 3 to facilitate cleaning of the filament 20 by rotating the support structure 10 along cleaning path 42 while retaining the filament 20 in fixed position. The axis of rotation of the support structure 10 is substantially coincident with the center of the polygon formed by filament 20.

Figure 2B:
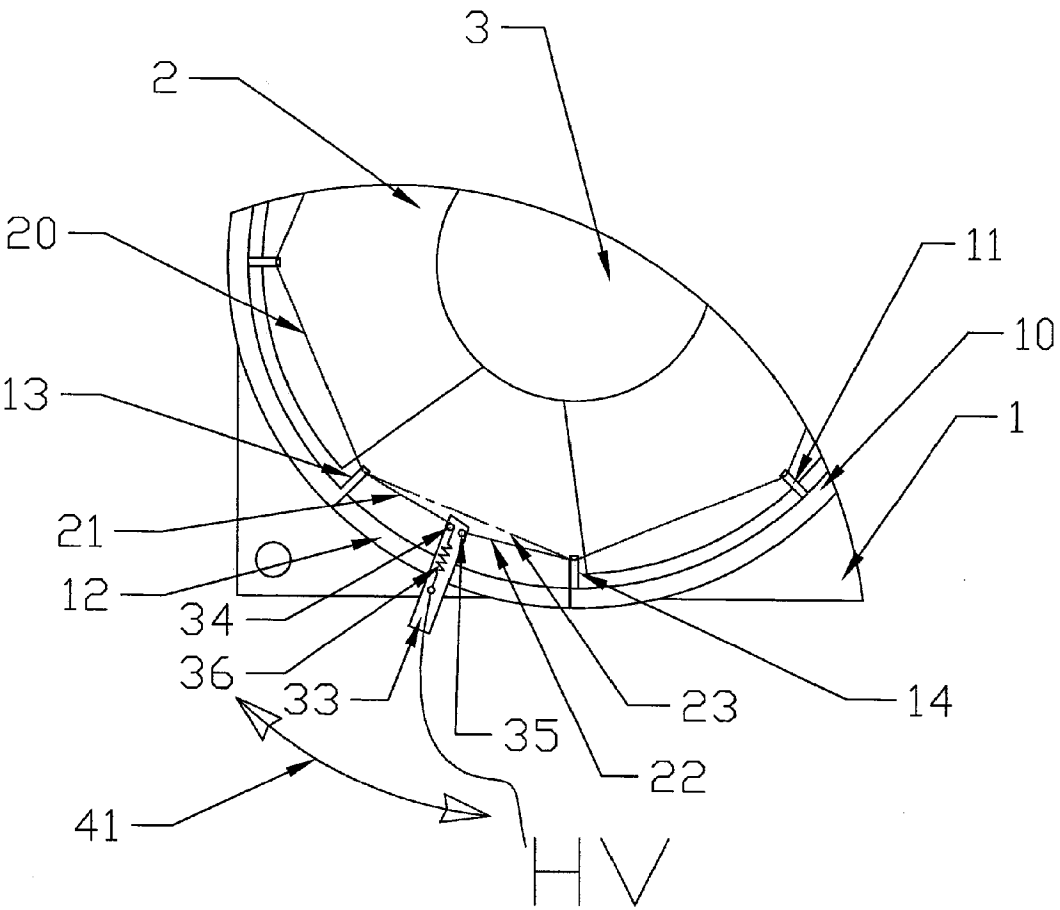

FIG. 2*b* shows a partial view of the same area of the fan module 1 as shown in FIG. 2*a* and illustrates compensation for changes in length of the perimeter of the polygon formed by filament 20. During a cleaning procedure the lever 33 and the attachment points 34 and 35 for the filament 20 that are carried by the lever 33 are shown moving along the arc in this illustrated embodiment, and such attachment points deviate from the line intercept 23 between supports 13 and 14. Because the sum of the lengths of segments 21 and 22 of the filament 20 is greater than the length of the line intercept 23, there is a need to compensate for the changes in required length of the filament 20 during movement of the lever 33 over the cleaning path 41. This is achieved by attaching filament 20 to spring 36, or other elastic element, or by otherwise accommodating changing distance between attachment points 34 and 35. One such technique includes resilient supports 13, 14, or other supports 11, that can adjust at least radially to accommodate a fixed length of filament 20 so moved along the cleaning path 41.

Figure 3:
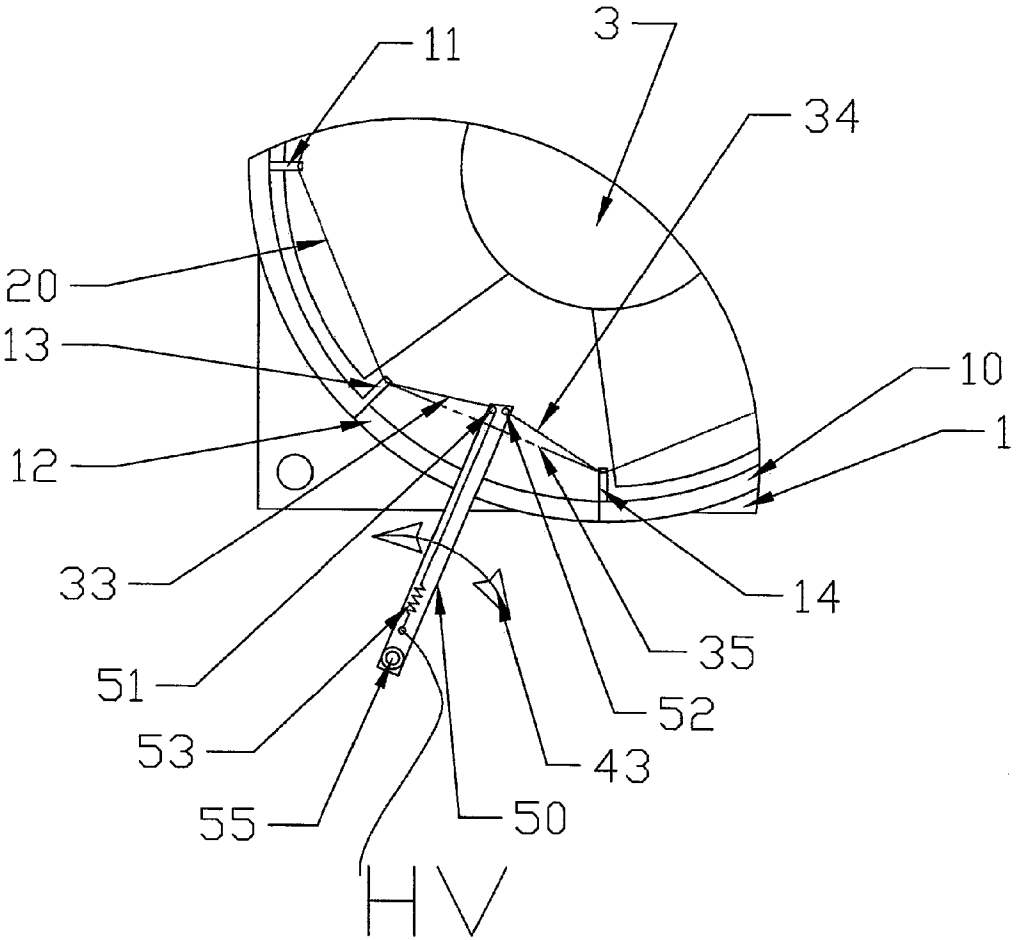
FIG. 3 is a frontal partial view of an ionizing blower from the impeller side of the fan module showing a lever mechanism in accordance with yet another embodiment of the present invention.

In another embodiment of the present invention, as shown on FIG. 3, the filament 20 is moved along a cleaning path via pivoted lever 50. FIG. 3 shows a partial view of the same region of the fan module 1 as FIGS. 2*a* and 2*b*. Lever 50 is disposed to rotate around pivoting point 55 along path 43 within the region 12 between supports 13 and 14. Pivoting point 55 may be situated outside of the support structure 10, or optionally within the perimeter of the support structure 10. Elastic element such as spring 53 may be mounted on lever 50 to accommodate changes in the required length of filament 20 as lever 50 is moved along the cleaning path 43.

Figure 4:
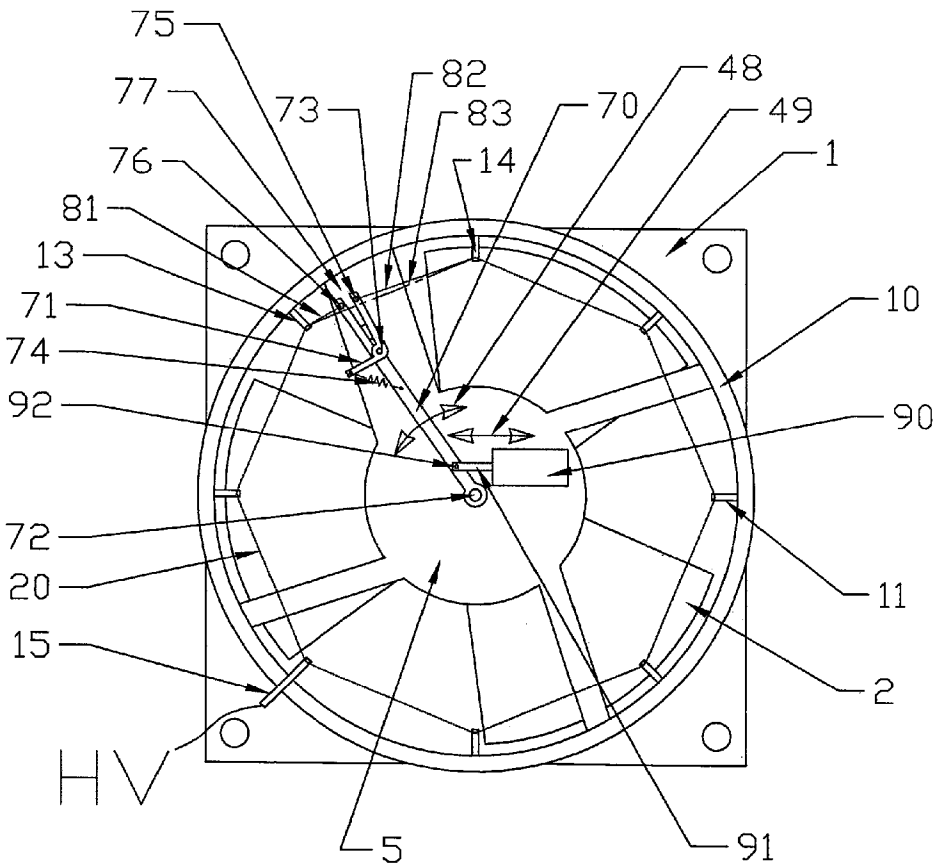
FIG. 4 is a frontal view of an ionizing blower from the side opposite the impeller side of the fan module showing another lever mechanism in accordance with yet another embodiment of the present invention.

In another embodiment of present invention the filament 20 is disposed on the output side of the fan module 1 where the support 5 for the fan motor is located. FIG. 4 shows the support structure 10 installed coaxially with the rotational axis of the fan blades 2 on the output side of the fan module 1. Lever 70 is mounted on the support 5 for pivotal movement around pivoting point 72 that may be positioned concentrically with the polygon formed by filament 20. Lever 70 rotates along path 48 between supports 13 and 14, and compensation for the required changes in filament length is achieved by altering the distance 77 between filament attachment points 75 and 76. In one embodiment of the present invention, the attachment point 76 is located on lever 70 and attachment point 75 is located on an auxiliary lever 71 that pivots around pivoting point 73 located on lever 70. Elastic element such as spring 74 between levers 70 and 71 maintains tension on filament 20 and compensates for change in required length of filament 20 during movement of lever 70 along the cleaning path 48. Of course, a single U-shaped lever made of elastic material may serve the same purpose. High ionizing voltage is supplied to filament 20 through support 15. Cleaning of the filament 20 is accomplished by rotating the support structure 10 while holding the filament 20 in fixed position, while sliding the supports 11, 13, 14, 15 over the filament, or by rotating lever 70 to slide the filament 20 through the supports 11, 13, 14, 15 in fixed position.

One or more of the supports 11 can protrude radially outside of the support structure 10 to facilitate both ease of rotating and, additionally, can intrude radially and be shaped as vanes for redirecting (collimating) the ionized air stream formed by the apparatus as described. Of course, the pivoting point 72 on lever 70 can also be placed outside the perimeter of support structure 10.

Movement of support structure 10, or of lever 70, can be performed manually, or via an actuator such as solenoid 90 mounted on support 5 to apply force 49 to rotate the lever 70.

Figure 5:
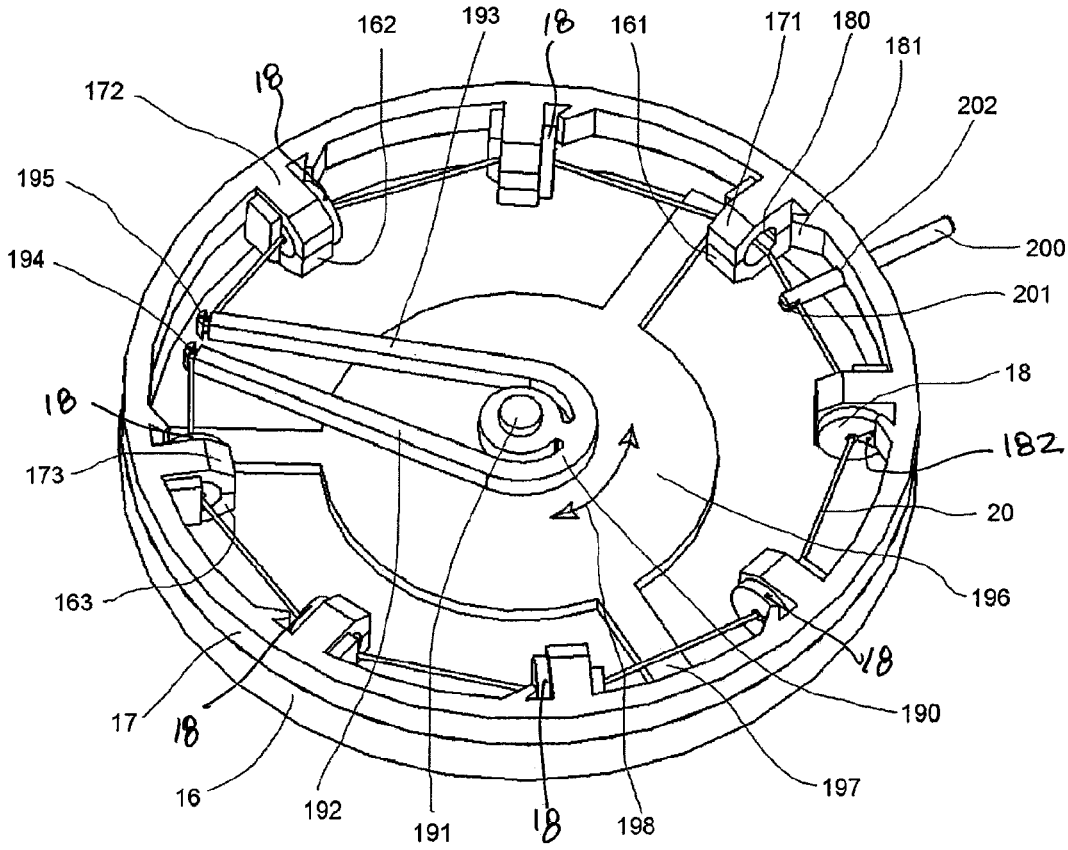
FIG. 5 is a detailed isometric view of a filament support and cleaning module in accordance with yet another embodiment of the present invention.

Referring now to FIG. 5, there is shown a detailed view of the support structure and cleaning mechanism according to another embodiment of the present invention. The support structure comprises a body that includes a lower ring 16 and an upper ring 17. Each ring includes lower and upper portions of the supports 161 and 171, respectively. These supports form non-circular apertures 180 in which split bushings 18 can be placed and secured by protrusions 181. Rings 16 and 17 can be molded of inexpensive plastic and the bushings 18 can be formed of material such as ceramic with high hardness and good resistivity to plasma and vibration. Bushings 18 are keyed by non-circular apertures 180 in a particular way with a radial split 182 oriented outwardly from the center of the support structure. Stretched filament 20 only contacts inner surfaces of the bushings 18, and does not contact plastic rings 16 and 17. The distance between supports 162 and 172 and 163 and 173 may be larger than between other supports. Lever 190 is pivotally mounted to rotate around shaft 191, substantially concentrically within the support structure, along path 198. Arms 192 and 193 of the lever 190 serve as flat resilient springs between supports 162/172 and 163/173. The ends of filament 20 are attached at points 194 and 195 on respective arms 192 and 193 of the lever 190. Spring resilience of the arms 192 and 193 keeps the filament 20 in tension and helps compensate for required length changes of the filament during a cleaning procedure in which the filament 20 is pulled through bushings 18 to remove adherent contaminants. The support structure may be rotated relative to the filament 20 retained in fixed position, or the lever 190 and filament 20 may be rotated relative to the bushings 18 held in fixed position.

High ionizing voltage is supplied to the filament 20 via pin 200 that protrudes outside the support structure for connection to a high ionizing voltage supply. Pin 200 may include a slot 201 for engaging the filament 20 and can protrude through hole 202 in support structure. Alternatively, high ionizing voltage may be supplied to filament 20 via at least one conductive bushing 18 that connects to a supply of high ionizing voltage. Also, high ionizing voltage can be supplied to filament 20 through contactless capacitive connection.

The shaft 191 is mounted on plate 196 that is supported via ribs 197 that may be formed as an integral portion of ring 16. The lever 190 with a predetermined length of filament 20 attached thereto can be mounted on shaft 191 with the filament 20 placed into the partial holes 180 in the lower ring supports. The upper ring 17 is then attached to lower ring 16 with glue, snaps, or other known attachment schemes. Then, bushings 18 with radial splits 182 are slipped over the filament 20 and snapped into holes 180 to configure and tension the filament 20 in a polygonal shape. This forms the entire assembly for attachment outside of a fan module and for easy removal to reduce cost of construction, maintenance and repair.

What is claimed is:

1. Ion generating apparatus comprising:

a housing including a support structure substantially surrounding a central region;

a plurality of supports mounted on the support structure and projecting inwardly therefrom into the central region; and an ionizing electrode including a conductive filament supported along a path including a plurality of the support for relative movement between the filament and supports to remove contaminant on the filament upon passing the supports.

2. Ion generating apparatus according to claim 1 in which the supports are stationery and the filament is slidably movable relative to the supports.

3. Ion generating apparatus according to claim 1 in which the filament is stationary and the support structure including the supports attached thereto are movable to slide along the filament.

4. Ion generating apparatus according to claim 1 in which both the supports and the filament are movable relative to the housing.

5. Ion generating apparatus according to claim 1 including a fan having an inlet and an outlet for moving an air stream therethrough, and the support structure is disposed at the outlet of the fan with said central region positioned for passage of the air stream therethrough.

6. Ion generating apparatus according to claim 5 in which the supports are disposed at spaced locations about the support structure to support the filament thereon in a substantially polygonal configuration within said central region.

7. Ion generating apparatus according to claim 6 in which the filament includes opposed ends, and including a lever having attached thereto the opposed ends of the filament at a selected location along the polygonal configuration thereof.

8. Ion generating apparatus according to claim 1 in which each of the supports includes a bushing disposed to substantially surround the filament for wiping the surface thereof during relative movement of the filament and supports.

9. Ion generating apparatus according to claim 7 in which the lever disposed at the selected location along the polygonal configuration of the filament is disposed for relative movement of the filament and supports substantially between adjacent ones thereof.

10. Ion generating apparatus according to claim 1 including a conductive connection to the filament for supplying high ionizing voltage thereto.

11. Ion generating apparatus according to claim 7 including a conductive connection to the filament via a support or lever.

12. Ion generating apparatus according to claim 7 including a resilient tensioner of the filament disposed at a support or one of the opposed ends.

13. Ion generating apparatus according to claim 7 in which the lever is pivoted within the central region of the support structure for movement of the lever and filament attached thereto relative to the support structure.

14. Ion generating apparatus according to claim 13 in which the lever includes at least one resilient arm attached to an opposed end of the filament for resiliently tensioning the filament with respect to an opposite end thereof.

15. Ion generating apparatus according to claim 7 in which supports adjacent the selected location are spaced farther apart than other adjacent supports disposed about the polygonal configuration of the filament to facilitate relative movement of the lever with attached filament and support structure over at least the distances between adjacent pairs of the plurality of supports.

16. A method of operating an ion generator in a flowing air stream to generate ions in the flowing air stream, the method comprising:

forming a support structure having a central region disposed to pass a flowing air stream therethrough;

supporting a conductive filament within the central region at a plurality of support locations thereabout in a substantial polygonal configuration;

supplying high ionizing voltage to the filament; and relatively moving the support locations and filament to wipe the surface thereof at each support location.

17. The method according to claim 16 in which the filament has opposed ends; and including tensioning the filament about the support locations between the opposed ends.

* * * * *